US009365971B2

(12) United States Patent
Heinz et al.

(10) Patent No.: US 9,365,971 B2
(45) Date of Patent: Jun. 14, 2016

(54) METHOD OF, AND APPARATUS FOR, FOLDING ITEMS OF LAUNDRY

(71) Applicant: Herbert Kannegiesser GmbH, Vlotho (DE)

(72) Inventors: Engelbert Heinz, Vlotho (DE); Jörg Sielmann, Bielefeld (DE); Jürgen Meier, Porta Westfalica (DE); Kai Kröger, Porta Westfalica (DE)

(73) Assignee: Herbert Kannegiesser GmbH, Vlotho (DE)

( * ) Notice: Subject to any disclaimer, the term of this patent is extended or adjusted under 35 U.S.C. 154(b) by 0 days.

(21) Appl. No.: 14/591,155

(22) Filed: Jan. 7, 2015

(65) Prior Publication Data

US 2015/0191867 A1 Jul. 9, 2015

(30) Foreign Application Priority Data

Jan. 7, 2014 (DE) ..... 10 2014 000 047

(51) Int. Cl.

*D06F 89/00* (2006.01)
*D06F 89/02* (2006.01)
*B65H 45/16* (2006.01)

(52) U.S. Cl.

CPC ..... *D06F 89/00* (2013.01); *B65H 45/16* (2013.01); *D06F 89/02* (2013.01)

(58) Field of Classification Search

CPC ..... D06F 89/00; D06F 89/02; D06F 89/023; B65H 45/00; B65H 45/04; B65H 45/12; B65H 45/16; B60R 21/237

See application file for complete search history.

(56) References Cited

U.S. PATENT DOCUMENTS 3,363,897 A * 1/1968 Northern ..... D06F 89/00 493/23
3,485,492 A * 12/1969 Iltis ..... D06F 89/00 368/118
3,797,820 A * 3/1974 McDermott ..... D06F 89/00 493/14
3,905,593 A * 9/1975 Behn ..... B65H 45/18 493/17

(Continued)

FOREIGN PATENT DOCUMENTS

EP 2327830 A1 6/2011
EP 2392727 A1 12/2011
GB 988477 A 4/1965

OTHER PUBLICATIONS

European Patent Office, Europaischer Recherchenbericht (EPO Search on related application EP 14003788), May 18, 2015.

*Primary Examiner* — Ismael Izaguirre
(74) *Attorney, Agent, or Firm* — Laurence P. Colton; Smith Tempel Blaha LLC

(57) ABSTRACT

During the transverse-folding operation of items of laundry, a number of layers are positioned one above the other so as to overlap one another. In order to achieve optimum folding quality, the aim is for layers of equal length to overlap, which is only rarely possible in practice. It is usually the case that the layers are of unequal length, and this gives rise to a difference in overlap. The invention makes provision for the difference in overlap to be eliminated, or at least to be minimized, in that it is determined whether a difference in overlap is present and the difference in overlap which may be established is corrected for the transverse-folding operation of the next-following item of laundry, which allows established differences in overlap to be compensated for automatically at least for the most part.

17 Claims, 5 Drawing Sheets

(56) References Cited

U.S. PATENT DOCUMENTS 4,234,179 A * 11/1980 Weir ..... B65H 45/04 493/14
4,479,640 A * 10/1984 Smith ..... D06F 89/00 223/37
5,556,360 A * 9/1996 Kober ..... D06F 89/00 493/23
5,624,366 A * 4/1997 Beeri ..... B65H 45/04 493/23
2004/0226198 A1 * 11/2004 Borucki ..... D06F 67/04 38/143

* cited by examiner

METHOD OF, AND APPARATUS FOR, FOLDING ITEMS OF LAUNDRY

STATEMENT OF RELATED APPLICATIONS

This application claims the benefit of German Patent Application No. DE 10 2014 000 047.8 having a filing date of 7 Jan. 2014.

BACKGROUND OF THE INVENTION

1. Technical Field

The invention relates to a method of folding items of laundry wherein the items of laundry, in a folding apparatus, are folded transversely at least once in relation to the direction of passage through the folding apparatus and, in the process, are at least more or less halved lengthwise, as seen in the through-passage direction, as a result of overlapping layers of the item of laundry being formed, and to an apparatus for folding items of laundry having at least one transverse-folding station and having belt conveyors, by means of which the item of laundry which is to be folded in each case is transported in the through-passage direction through at least one transverse-folding gap, which belongs to the at least one transverse-folding station and in which the respective item of laundry receives a transverse fold, which runs transversely to the through-passage direction and which produces overlapping layers of the item of laundry.

2. Prior Art

Items of laundry, to be precise, in particular, flat textile products (tablecloths, towels, duvet covers, pillowcases, sheets and the like), but also items of clothing such as bathrobes, are folded automatically, using folding machines, in laundries. The items of laundry here are folded transversely at least once and, in the process, shortened in length by a number of layers of the item of laundry being positioned one above the other in an overlapping manner. "Length" of the items of laundry is intended to mean the direction of extent of the same in the transporting direction through the folding machine. This need not just be the largest dimension, referred to generally as length; in the case of items of laundry transported transversely through the folding machine, it may also be a shorter, transverse dimension (referred to usually as width). "Transverse-folding operation" is to be understood as being a folding operation which produces a folding line which extends through the items of laundry and extends transversely to the direction in which the items of laundry are transported through the folding machine, and thus also transversely to the length.

Optimum folding results are achieved if, in the case of the respective transverse-folding operation, the layers positioned one above the other are of equal length and thus the transverse edges, running transversely to the through-passage direction through the folding machine, or transversely directed ends of the layers are located precisely one above the other. In practice, this is not achieved for various reasons, to be precise, in particular, the material properties of the items of laundry, but also influences stemming from the folding machine; there is therefore usually a so-called overlap. The folding machines which have been known up until now tolerate the difference in overlap to a certain extent. The folding quality suffers as a result because transverse edges or transverse ends of the laundry-item layers positioned one above the other are not located quite precisely one above the other. It is only when the difference in overlap becomes large enough to impair the folding quality in a manner which is no longer tolerable that the attempt is made to reduce the difference in overlap by altering mechanical settings of the folding machine. This requires often relatively long stoppages of the folding machine and some skill and experience on the part of the engineer. It is frequently also the case, for reasons relating to cost, that alterations to the folding-machine setting are not made and poor folding results are accepted.

BRIEF SUMMARY OF THE INVENTION

Proceeding from the above, it is an object of the invention to provide a method of, and an apparatus for, folding items of laundry, by way of which differences in overlap are compensated for automatically at least for the most part.

This object is achieved by a method of folding items of laundry, wherein the items of laundry, in a folding apparatus, are folded transversely at least once in relation to the direction of passage through the folding apparatus and, in the process, are at least more or less halved lengthwise, as seen in the through-passage direction, as a result of overlapping layers of the item of laundry being formed, characterized in that it is determined whether at least one difference in overlap is present and any difference in overlap which may be determined is corrected for the following item of laundry. Accordingly, in the case of at least one transverse-folding operation, in particular following the transverse-folding operation or towards the end, or just prior to the end, of the transverse-folding operation, it is determined whether a difference in overlap is present. If a difference in overlap, or at least one significant difference in overlap, has been determined, this is used in order to correct correspondingly the transverse-folding operation of the following item of laundry. The difference in overlap established during the folding operation of an item of laundry is thus gradually balanced out altogether, or at least largely reduced, in one or more successive steps by auto-adaptation.

Provision is preferably made for the difference in overlap to be determined continuously. This means that the folding operation is not adversely affected by determination of the respective difference in overlap. In particular, there is no need for the respective folding operation to be interrupted in order for the difference in overlap which may possibly arise to be determined.

In the case of an advantageous configuration of the method, the difference in overlap is determined by virtue of opposite ends of the respective item of laundry being detected. If the difference in overlap is determined in the case of the first transverse-folding operation of the item of laundry, detection of the two opposite transverse edges of the item of laundry takes place in order to determine the difference in overlap. The transverse edges are those edges which are directed transversely to the direction in which the item of laundry passes through the folding machine. This detection makes it possible to determine straightforwardly, and preferably contactlessly, whether the transverse edges or, in the case of items of laundry which have already been folded transversely once beforehand, the ends running transversely to the transporting direction through the introduction machine are located one above the other, that is to say there is no difference in overlap. If a difference in overlap is established, the extent to which the transverse edges or ends deviate from one another, that is to say how far apart they are, is also determined. It is preferable for the two transverse edges or ends of the item of laundry to be determined just upstream of the respective transverse-folding location, that is to say just prior to completion of the transverse-folding operation. Measurement upstream of the transverse folding location is recommended because, here, the rear transverse edges or ends of the item of laundry which are to be detected do not yet overlap and can thus be determined separately in a straightforward and reliable manner. As the ends or transverse edges of the overlapping layers of the item of laundry are determined just upstream of the transverse-folding location, the difference in overlap which is to be expected can be established with a high level of reliability even though, at this point in time, the transverse edges or ends of the item of laundry are not yet located one above the other.

Furthermore, provision is preferably made, in the case of the transverse-folding operation of a number of successive items of laundry, preferably of all the successive items of laundry, for the differences in overlap of the items of laundry to be determined in the same transverse-folding station. This means that the difference in overlap is determined repeatedly or every time. This allows continuous correction of the difference in overlap arising during the preceding transverse-folding operation. This results in the greatest possible reduction in the difference in overlap and preferably in complete, or more or less complete, elimination of the difference in overlap and thus in an optimum folding quality.

According to another advantageous configuration of the method, provision is made for the established difference in overlap to be balanced out or to be compensated such that, depending on whether a positive or negative difference in overlap has been determined, the transverse-folding operation of the next item of laundry takes place when the half-length of the item of laundry plus or minus half the difference in overlap is located at the relevant transverse-folding location. It is therefore the case that the transverse folding of the next-following item of laundry does not take place precisely in the center (in relation to the length in the through-passage direction through the folding machine), but by half the previously established difference in overlap ahead or behind of the center. It is thus possible for the center of the item of laundry to be displaced by computational means such that a previously established difference in overlap would necessarily be compensated for in the next-following item of laundry.

An advantageous development of the method makes provision, prior to the first transverse-folding operation, for a length measurement of the respective item of laundry to be carried out, that is to say the measurement of the distance between the transverse peripheries running transversely to the direction in which the item of laundry passes through the folding machine. This length measurement makes it possible to determine the center of the respective item of laundry, at which the first transverse-folding operation theoretically has to take place. These centers are then displaced forwards and rearwards if appropriate by the previously established half difference in overlap so that, in the case of the following transverse-folding operation of the item of laundry which has been measured lengthwise, it is possible to balance out, or compensate for, the extent of overlap determined for the preceding item of laundry. As the item of laundry is measured in length prior to the first transverse-folding operation, the length and center of each item of laundry are known in good time, and they can therefore be taken into account for determining the location at which the respective item of laundry is transported into the transverse-folding location.

In the case of items of laundry which are provided with a number of transverse folds, provision is preferably made for the difference in overlap to be determined for a number of, in particular all, the transverse-folding operations. As a result, the differences in overlap can be corrected, and ideally eliminated, not just for the first transverse-folding operation, but also for one or more following transverse-folding operations for folding the following item of laundry or the following items of laundry. It is preferably the case that the differences in overlap are corrected in relation to the respectively associated transverse-folding station or transverse-folding location, that is to say the difference in overlap is eliminated, or reduced, wherever it has occurred.

An apparatus for achieving the object mentioned in the introduction is an apparatus for folding items of laundry, having at least one transverse-folding station and having belt conveyors, by means of which the item of laundry which is to be folded in each case is transported in the through-passage direction through at least one transverse-folding gap, which belongs to the at least one transverse-folding station and in which the respective item of laundry receives a transverse fold, which runs transversely to the through-passage direction and which produces overlapping layers of the item of laundry, characterized by the arrangement, on opposite sides at least one of transverse-folding gap, of detection means for opposite ends of the respective item of laundry which run transversely to the through-passage direction. This apparatus, on opposite sides of at least one folding gap, has detection means provided for opposite ends of the respective item of laundry. The detection means sense independently of one another, to be precise preferably in a contactless manner, the end of each layer of the item of laundry which is currently being folded transversely. Since the detection means are arranged on opposite sides of the folding gap, they sense the end of each layer of the item of laundry formed in the case of the transverse-folding operation before they are positioned one above the other during the transverse-folding operation. Prior to being positioned one above the other, the ends are still separate and can thus be detected straightforwardly and most likely in a reliable manner.

The detection means are preferably arranged on different sides of the respective folding gap, each at an equal distance from the folding gap. This means that differences in distance or possibly also differences in time in the detection of the two opposite ends of the respective item of laundry are determined and any possible differences in overlap are thus established.

A preferred configuration of the apparatus provides for at least one distance sensor. The distance sensor preferably interacts with the detection means on opposite sides at least of the folding gap for the first transverse-folding operation. The distance sensor makes it possible to determine the distance covered by the item of laundry between successive detections of the opposite ends, in particular transverse peripheries. The distance measured by the distance sensor between the detection of the first and the second opposite ends of the item of laundry then gives the difference in overlap directly. This means that the difference in overlap can be determined straightforwardly and, in particular, reliably.

According to an advantageous configuration of the apparatus, a length-measuring device for determining the dimension extending in the through-passage direction, in particular the length, of the item of laundry which is to be folded in each case is provided upstream of the first transverse-folding station. The length-measuring device determines the length, that is to say that dimension of the item of laundry which extends in the direction in which the item of laundry passes through the folding machine, between opposite ends or transverse edges. This can be used to calculate, by halving the distance measured, the center or centre axis of the item of laundry, at which the item of laundry is folded transversely along the center of its length at the first transverse-folding station. The length-measuring device is preferably arranged upstream of the first transverse-folding station at least by half the length of the largest item of laundry which is to be folded. This ensures that the center of the item of laundry, or the laundry-item center axis running transversely to the direction in which the item of laundry passes through the folding machine, can be determined from the previously measured overall length before the item of laundry is conveyed into the folding gap of the first transverse-folding station with the determined center or transversely directed center axis in front.

BRIEF DESCRIPTION OF THE DRAWINGS

A preferred exemplary embodiment of the invention will be explained in more detail hereinbelow with reference to the drawing, in which.

DETAILED DESCRIPTION OF PREFERRED EMBODIMENTS

The apparatus shown in the figures serves for folding items of laundry 10 automatically. The latter may be all items of laundry which are suitable for automatic folding, in particular flat textile products such as, for example, bed linen, table linen and towels, but also items of clothing such as, for example, bathrobes.

Figure 1:
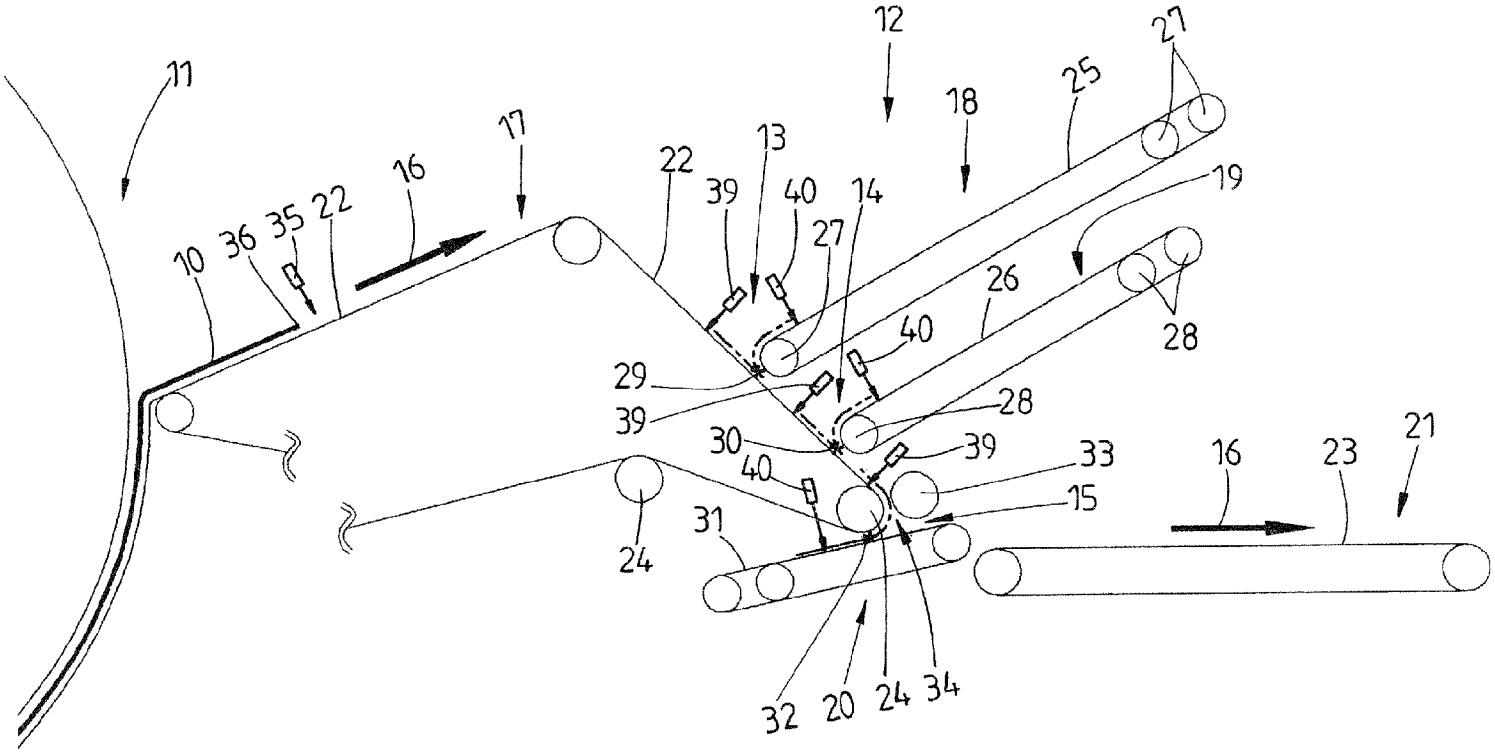
FIG. 1 shows a schematic side view of an apparatus for folding items of laundry.

In the exemplary embodiment shown, the apparatus shown for folding the items of laundry 10 is arranged downstream of a trough mangle 11, of which a rear part, that is to say the delivery side, is illustrated only in FIG. 1.

The schematically shown apparatus for folding items of laundry 10, that is to say the folding apparatus 12, has three transverse-folding stations 13, 14 and 15 following one after the other. However, the invention is not restricted to this. Thus, the invention also relates to folding apparatuses 12 with a larger or smaller number of transverse-folding stations and also to folding apparatuses 12 having at least one transverse-folding station 13 and one or more longitudinal-folding stations.

The items of laundry 10 are transported one after the other in the direction 16 of passage through the folding apparatus 12, in particular the transverse-folding station 13, 14 or 15, wherein, depending on the size of the item of laundry 10, the latter is folded transversely only at one transverse-folding station 13 or merely at two transverse-folding stations 13, 14, or 15. It is usually only long items of laundry 10 which are folded transversely one after the other at all three transverse-folding stations 13, 14, 15.

The items of laundry 10 can be transported in the direction 16 of passage through the folding apparatus 12 either in a longitudinally directed manner or in a transversely directed manner, to be precise also in alternating fashion. Wherever "length" of the items of laundry 10 is referred to hereinbelow, this refers to the distance between parallel ends, edges, or peripheries of the items of laundry 10 in the through-passage direction 16, that is to say the length, in the case of items of laundry 10 transported through the folding apparatus 12 in a longitudinally directed manner and the width, in the case of items of laundry 10 transported through the folding apparatus 12 in a transversely directed manner. Folded transversely means that the items of laundry 10 are provided with a transverse fold, which runs transversely to the through-passage direction 16, in the respectively active transverse-folding station 13, 14, or 15. The items of laundry 10 here are folded along their length, that is to say each of them has their length halved, in each transverse-folding station 13, 14, and 15. This gives rise to a number of layers of the items of laundry 10 being positioned one above the other, wherein those layers of the items of laundry 10 which are positioned one above the other during the transverse-folding operation overlap.

The folding apparatus 12 shown here, having just three transverse-folding stations 13, 14, and 15, has a number of belt conveyors 17, 18, 19, 20, and 21. The belt conveyors 17 to 21 each have one belt, which is continuous over the entire operating width of the folding apparatus 12, or a number of relatively narrow belts arranged one beside the other.

A first belt conveyor 17 is driven preferably continuously in the same direction, and therefore its upper strand 22 runs constantly in the through-passage direction 16. The same applies preferably to the belt conveyor 21 for transporting away definitively folded items of laundry 10. Its upper strand 23 consequently also moves in the through-passage direction 16.

The first belt conveyor 17, by means of which the item of laundry 10 which is to be folded in each case is also transported to the transverse-folding stations 13, 14, and 15, is guided around a number of deflecting drums 24, of which at least one can be driven. The upper strand 22 of the belt conveyor 17 has an approximately roof-form progression. The belt conveyors 18 and 19 are arranged laterally alongside the second portion of the upper strand 22, said second portion being directed downwards from the uppermost deflecting drum 24. These belt conveyors 18 and 19 have rectilinear upper strands 25 and 26, which run parallel to one another in the exemplary embodiment shown. Lower-level ends of the upper strands 25, 26 of the belt conveyors 18 and 19 are directed towards the downwardly running second portion of the upper strand 22 of the belt conveyor 17. It is also the case that the conveying belts of the belt conveyors 18 and 19 are guided around deflecting drums 27 and 28, respectively, of which at least one can be driven. Narrow gap clearances, forming a transverse-folding gap 29 or 30 for the respective transverse-folding station 13 or 14, are formed between the downwardly directed, second portion of the upper strand 22 of the belt conveyor 17 and those ends of the belt conveyors 18 and 19 which are directed towards said second portion.

The transverse-folding station 15 is formed differently, to be precise by the belt conveyor 20, which is provided beneath a deflecting drum 24 defining the end of the upper strand 22 of the belt conveyor 17. A transverse-folding gap 32 of the third transverse-folding station 15 is formed between the lower deflecting drum 24 at the end of the upper strand 22 of the belt conveyor 17 and an upper strand 31 of the belt conveyor 20. The deflecting drum 24 at the lower end of the upper strand 22 of the belt conveyor 17 is assigned a directing drum 33. The latter can be driven in rotation preferably individually, but may also be of drive-free design. The directing drum 33 is located opposite the deflecting drum 24 at the end of the upper strand 22 and forms a through-passage gap 34 in relation to the end of the upper strand 22 of the belt conveyor 17.

The belt conveyor 21, which serves for transporting away folded items of laundry 10, follows an end of the belt conveyor 20, which is directed away from the trough mangle 11 and is intended for forming part of the third transverse-folding station 15. The belt conveyor 21 is arranged downstream of the belt conveyor 20 such that definitively folded items of laundry 10 can be transferred from the rear end of the belt conveyor 20 to the belt conveyor 21, by means of which the respectively folded item of laundry 10 is transported out of the folding apparatus 12, for example to a stacking device (not shown in the figures), in the through-passage direction 16.

The folding apparatus 12 is provided with a length-measuring device 35, which can determine the length of the respective item of laundry 10 in the through-passage direction 16. The length is given by the distance between the front transverse edge 36 of the item of laundry 10, said edge running transversely to the through-passage direction 16, and the rear transverse edge 37 thereof, said edge trailing in the through-passage direction 16. In the case of an item of laundry 10 which is not yet folded, these two transverse edges 36, 37 define opposite ends running transversely to the through-passage direction 16, that is to say the front end 36 and the rear end 37. The length-measuring device 35 detects, preferably in a contactless manner, first of all the front transverse edge 36 and then the rear transverse edge 37 of the item of laundry 10 as the latter is transported continuously past the length-measuring device 35. The length-measuring device 35 may be formed by a single contactless sensor, for example a light barrier. The sensor of the length-measuring device 35 is assigned to the start of the upper strand 22 of the belt conveyor 17 such that a measuring line/measuring axis or measuring barrier intersects the upper strand 22 approximately perpendicularly or slightly obliquely. The length-measuring device 35 is spaced apart from the first transverse-folding station 13 by a distance which is somewhat larger than half the length of the longest item of laundry 10 which is to be processed by the folding apparatus 12. This ensures that the length-measuring operation of all the items of laundry 10 of the relevant size has been completed before the centres of the items of laundry 10, that is to say center axes 38 of the same, said axes running transversely to the through-passage direction 16, have reached the first transverse-folding station 13. The center axes 38 are those axes of the items of laundry 10 which are located centrally between the transversely directed ends, in particular the front transverse edge 36 and the rear transverse edge 37, that is to say they define the half-length of the respective item of laundry 10.

The length-measuring device 35 is assigned a displacement sensor, which specifically measures the distance covered by the respective item of laundry 10 as it is transported through the folding apparatus 12 in the through-passage direction 16. The displacement sensor determines, inter alia, the length of the item of laundry 10, wherein the distance measurement is started when the front transverse edge 36 runs past the sensor of the length-measuring device 35. The operation of measuring the length of the item of laundry 10 is completed when the rear transverse edge 37 passes the sensor of the length-measuring device 35. The length-measuring device 35 generates measuring pulses for a displacement sensor assigned, for example, to a deflecting drum 24 of the belt conveyor 17. It is also possible, if appropriate, for the length-measuring device 35 itself to be designed in the form of a distance-measuring device.

In the case of the folding apparatus 12 shown here, each transverse-folding station 13, 14 or 15 is assigned two detection means 39, 40, which are positioned at different locations and operate preferably in a contactless manner. As an alternative, it is conceivable, and sufficient, for just the first transverse-folding station 13, or just the first two transverse-folding stations 13 and 14, to be assigned two detection means 39 and 40 in each case.

At least at the first transverse-folding station 13, the two detection means 39 and 40 are arranged upstream of the transverse-folding gap 29 at equal distances from the same, to be precise on opposite sides of the transverse-folding gap 29. The two detection means 39 and 40 are positioned centrally in relation to the operating width of the folding apparatus 12. The detection means 39 and 40 are equally designed in the form of contactless sensors, which are directed at a certain angle, preferably approximately perpendicularly, onto the item of laundry 10 which is to be folded. The angles of the sensors here are preferably equal. It is also conceivable, however, for each detection means 39 and 40 to be formed by a number of contactless sensors, for example light barriers, located one beside the other. The number of sensors for forming each detection means 39 and 40 are then each located on a common line running transversely to the direction 16 in which the items of laundry 10 pass through the folding apparatus 12.

The detection means 39 is assigned to the downwardly directed portion of the upper strand 22 of the conveyor 17, said portion bounding the transverse-folding gap 29 on one side. Conversely, the detection means 40 is assigned to that end region of the upper strand 25 of the conveyor 18 which is oriented towards the transverse-folding gap 29. Although the detection means 39, 40 are assigned to the upper strands 22, 25 of different conveyors 18, on the one hand, and 17, on the other hand, their measuring locations, that is to say the locations where the detection lines or detection beams come into contact with the upper strands 22 and 25, are at the same distance from the transverse-folding gap 29.

The item of laundry 10, which is to be provided with the first transverse fold in each case at the first transverse-folding station 13, has the front transverse edge 36 in the first instance deflected onto the upper strand 25 of the belt conveyor 18 upstream of the transverse-folding gap 29 of the first transverse-folding station 13. As soon as the item of laundry 10 has the center axis 38 positioned upstream of the transverse-folding gap 29, the belt conveyor 18 is reversed and the one half of the item of laundry 10 is transported into, and through, the transverse-folding gap 29 from the upper strand 22 of the belt conveyor 17, and the other half of the item of laundry 10 is transported into, and through, the transverse-folding gap 29 from the upper strand 25 of the belt conveyor 18. Even prior to completion of the transverse-folding operation in the first transverse-folding station 13, the detection means 39, 40 establish when the front transverse edge 36 passes the detection means 40 and when the rear transverse edge 37 passes the detection means 39. In conjunction with a displacement sensor, which possibly also corresponds with the length-measuring device 35, it is possible to determine a distance which the item of laundry 10 covers between the front transverse edge 36 running past the detection means 40 and the rear transverse edge 37 running past the detection means 39.

The detection means 39, 40 are arranged in basically the same way at the second transverse-folding station 14 and the third transverse-folding station 15. Accordingly, the detection means 40 of the transverse-folding station 14 is assigned to the upper strand 26 of the belt conveyor 19, whereas the detection means 40 of the third transverse-folding station 15 is assigned to the upper strand 31 of the belt conveyor 20. For all three transverse-folding stations 13, 14 and 15, the detection means 39 are assigned to the upper strand 22 of the belt conveyor 17, to be precise at a distance one behind the other in each case in the through-passage direction 16.

The method according to the invention will be explained in more detail hereinbelow, on the basis of an item of laundry 10 being transported continuously first of all through the trough mangle 11, and then through the folding apparatus 12, in a longitudinally directed manner, and thus lengthwise, along a single track. Furthermore, the method described hereinbelow is based on the item of laundry 10 being provided with a transverse fold, running transversely to the through-passage direction 16 in each case, in all three transverse-folding stations 13, 14, and 15, wherein the length of the item of laundry 10 is ideally halved during each transverse-folding operation and, in the process, the number of overlapping layers which the item of laundry 10 has located one above the other is doubled in each case.

FIG. 1 shows how the item of laundry 10, which is mangled in the trough mangle 11, leaves the delivery side of the trough mangle 11 by way of the front transverse edge 36. The item of laundry 10 here passes onto the upper strand 22 of the belt conveyor 17, which adjoins the delivery region of the trough mangle 11, and is transported continuously onwards by the upper strand 22 in the direction 16 of passage through the folding apparatus 12. As soon as the front transverse edge 36 of the item of laundry 10 reaches the length-measuring device 35 during said transportation, the operation of measuring the length of the item of laundry 10 is started by, for example, the distance covered from now on by the belt or the belts of the belt conveyor 17 being determined, for example by an angle-of-rotation sensor on a deflecting drum 24 of the belt conveyor 17.

Figure 2:
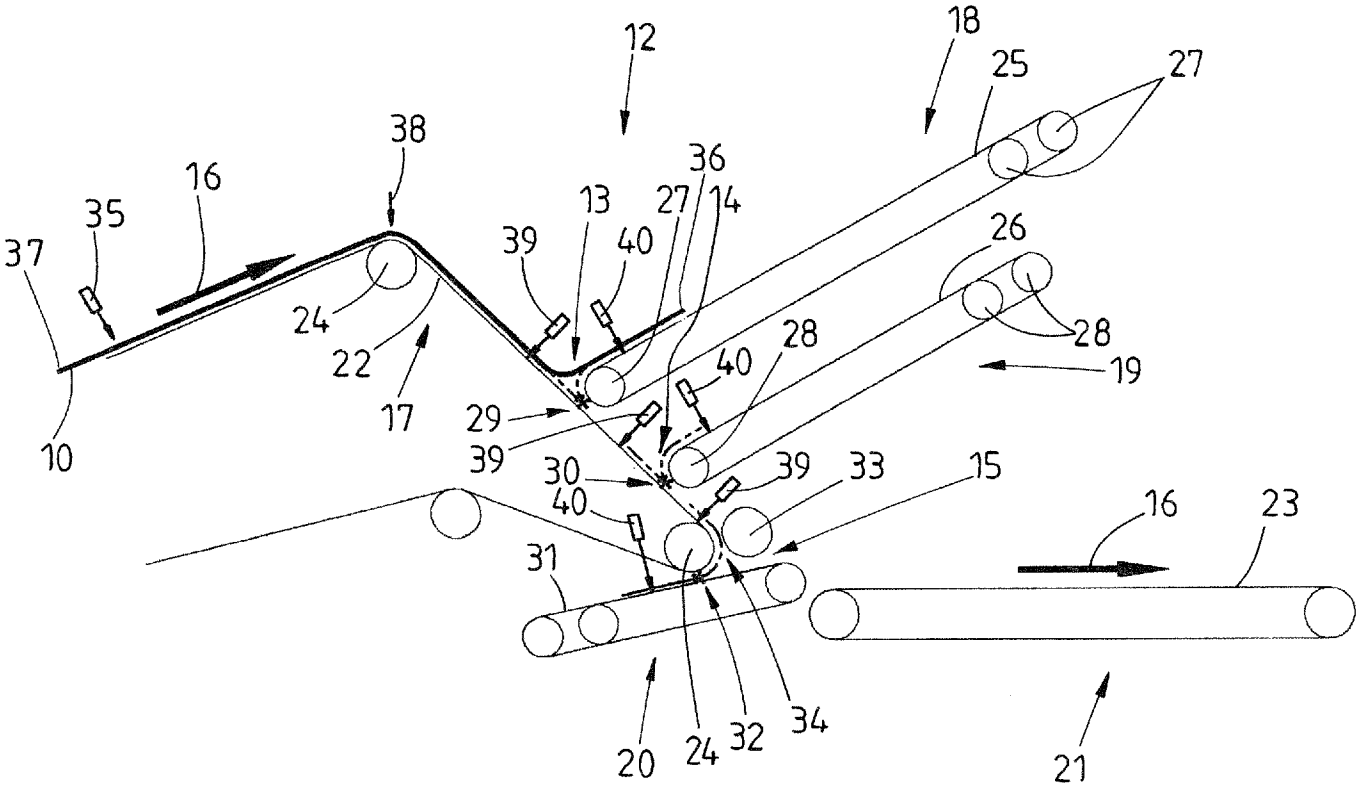
FIG. 2 shows the apparatus from FIG. 1 as an item of laundry is running past a length-measuring device.

In the illustration of FIG. 2, the item of laundry 10 has been transported onwards in the through-passage direction 16, to be precise to the extent where the front transverse edge 36 has passed onto the upper strand 25 of the belt conveyor 18. The front end region of the item of laundry is thus deflected onto the upper strand 25 of the belt conveyor 18 upstream of the first transverse-folding station 13. For this purpose, the belt conveyor 18 is driven in a direction in which the upper strand 25 moves away from the belt conveyor 17 and the first transverse-folding station 13. In the illustration of FIG. 2, a center axis 38, which runs transversely to the through-passage direction 16 and corresponds to the center or the half-length of the item of laundry 10, is located approximately above the uppermost deflecting drum 24 of the belt conveyor 17. At the same time, the rear transverse edge 37 of the item of laundry 10 is still located upstream of the length-measuring device 35, in other words it has not yet passed the same. This means that the operation of measuring the length of the item of laundry 10 has not yet been completed at this point in time.

Figure 3:
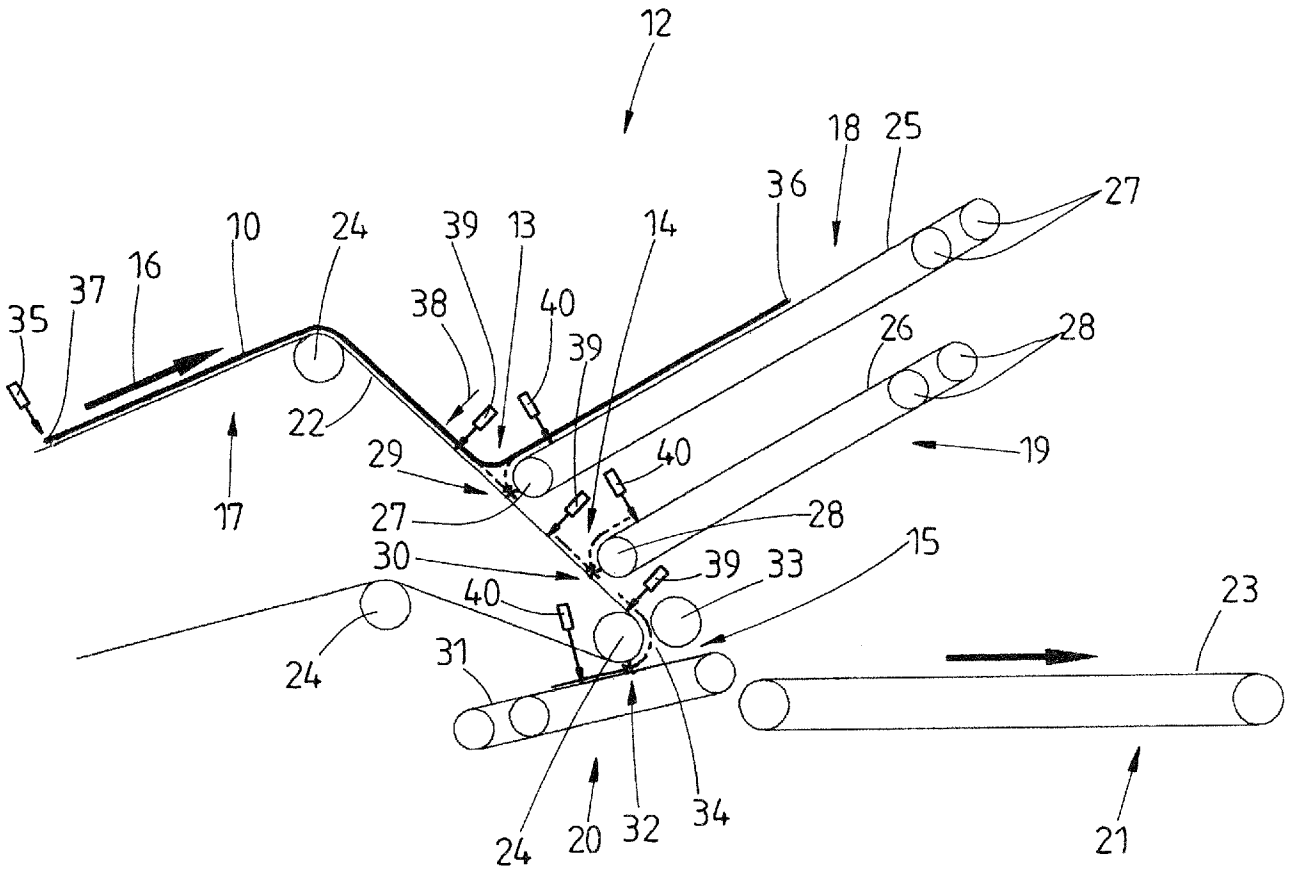
FIG. 3 shows the apparatus in an illustration from FIGS. 1 and 2 as the rear transverse edge of the item of laundry is passing the length-measuring device.
Figure 4:
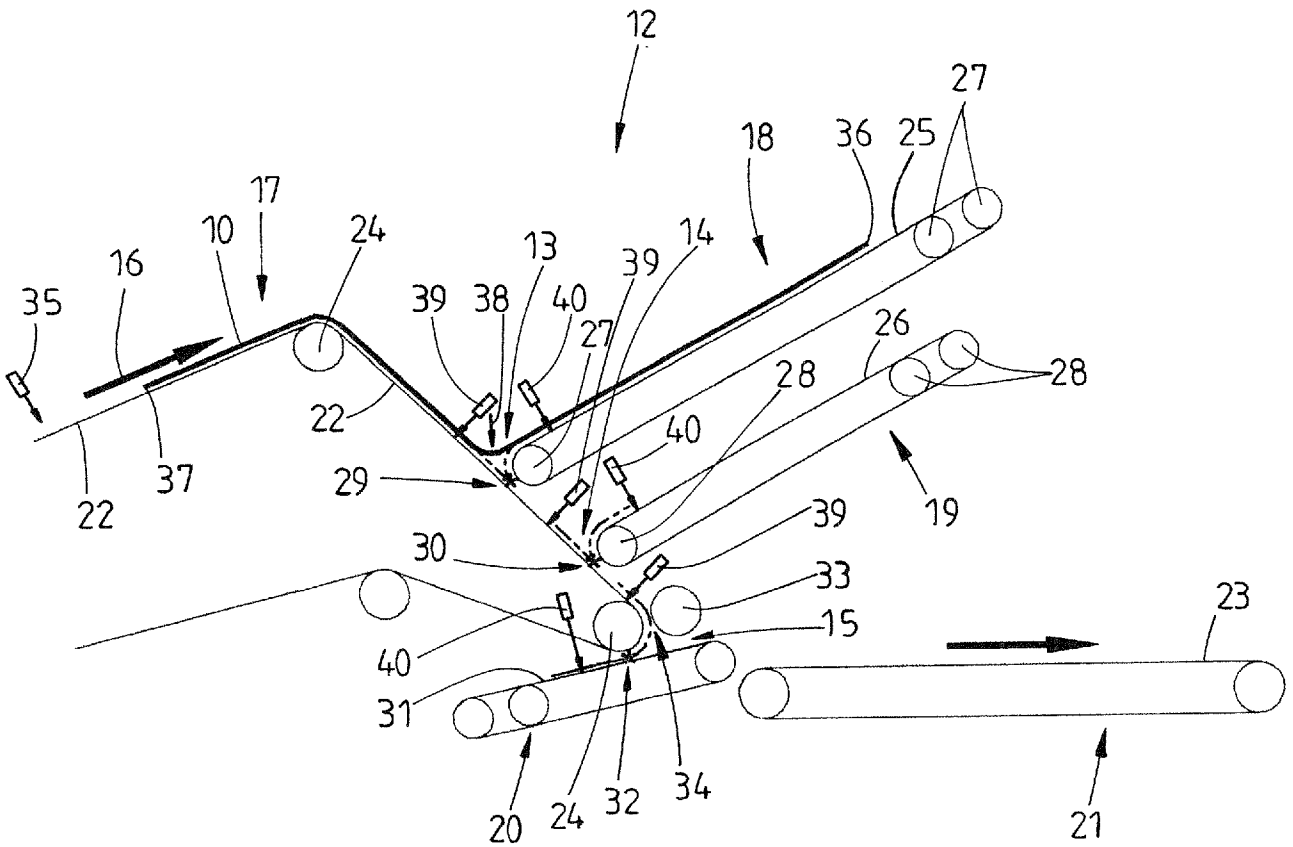
FIG. 4 shows the apparatus according to FIGS. 1 to 3 with the item of laundry located in a position suitable for the first transverse-folding operation.

FIG. 3 shows the completion of the operation of measuring the length of the item of laundry 10. At this point in time, the rear transverse edge 37 of the item of laundry 10 is passing the length-measuring device 35. The measured length of the item of laundry 10 can be used to determine by computational means the half-length, that is to say the center axis 38, of the item of laundry 10 and thus the location at which the first transverse-folding operation should take place. Measuring distance as the item of laundry 10 is transported onwards in the through-passage direction 16 makes it possible to determine when the center axis 38 is located in the correct position upstream of the transverse-folding station 13, that is to say upstream of, or above, the transverse-folding gap 29. This is illustrated in FIG. 4.

Once the center axis 38 of the item of laundry 10 is positioned upstream of, or above, the transverse-folding gap 29, the direction of rotation of the drive of the belt conveyor 18 is reversed, as the belt conveyor 17 is still driven continuously in the through-passage direction 16, as a result of which the front half of the item of laundry 10, said front half being located on the upper strand 25 of the belt conveyor 18, is transported in the opposite direction towards the belt conveyor 17 and thus towards the transverse-folding gap 29. This gives rise to the first transverse-folding operation in the transverse-folding station 13, wherein the item of laundry 10 is folded along the center of its length, the front and the rear halves being positioned one above the other in two overlapping layers.

Figure 5:
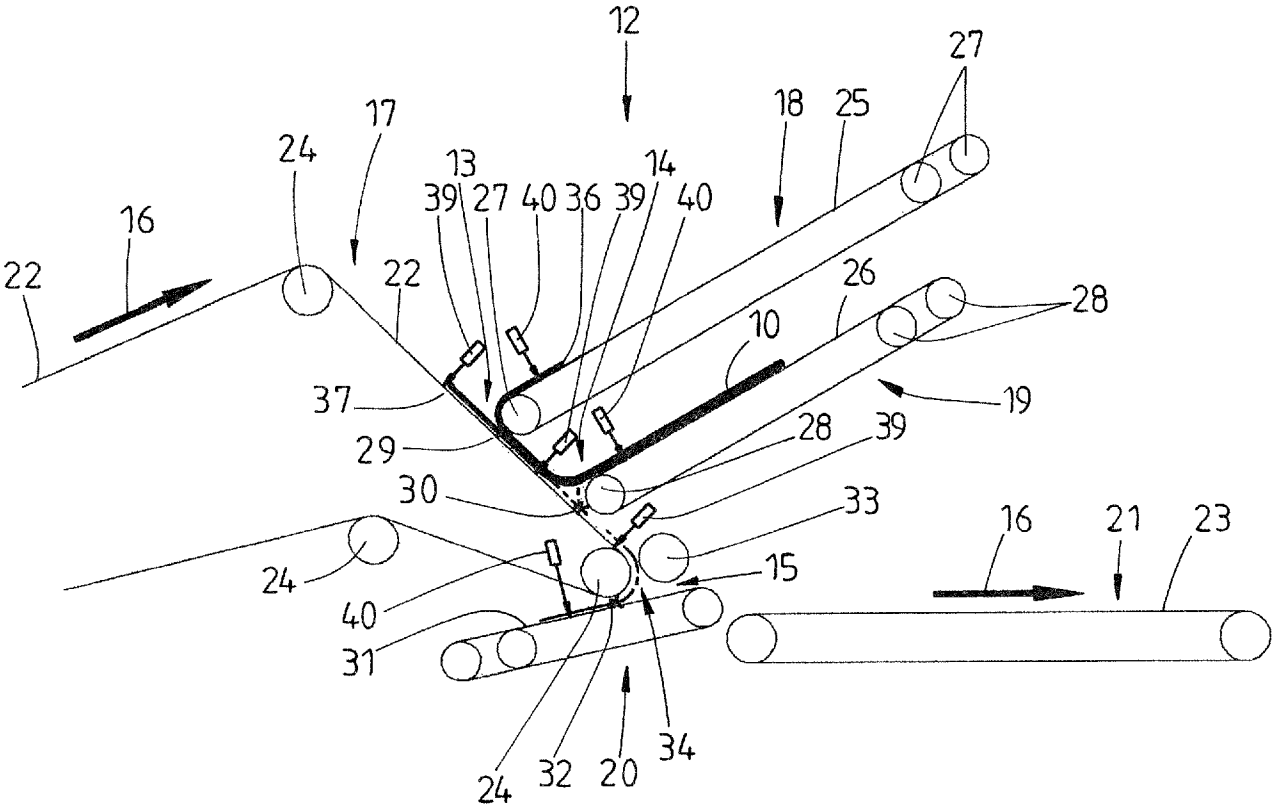
FIG. 5 shows the apparatus from FIGS. 1 to 4 with an item of laundry which is provided, for the most part, with a first transverse fold and of which the rear transverse edge is being sensed by the detection means.

FIG. 5 shows the for the most part completed first transverse-folding operation of the item of laundry 10 at the transverse-folding station 13. The front end of the item of laundry 10, folded transversely at the first transverse-folding station 13, with interconnected layers is redirected once again, upstream of the second transverse-folding station 14, onto the upper strand 26 of the belt conveyor 19 and, for this purpose, the item of laundry 10 is transported away from the belt conveyor 17 in the through-passage direction 16.

Just prior to completion of the first transverse-folding operation, in a particular manner according to the invention, the front transverse edge 36 and the rear transverse edge 37 of the item of laundry 10 are determined or detected. This takes place by way of the detection means 39 and 40 upstream of the first transverse-folding station 13. The detection means 39, which is assigned to the upper strand 22 of the belt conveyor 17, detects the rear transverse edge 37 of the item of laundry, that is to say the end of the lower layer, as it runs past. The detection means 40, which is assigned to the belt conveyor 18, determines the front transverse edge 36 of the upper layer of the item of laundry 10 as it runs past.

Ideally, the two transverse edges 36 and 37 should pass both the detection means 39 and the detection means 40 at the same time. In this case, the item of laundry 10 would be folded exactly in half. In practice, however, there is a so-called difference in overlap, where the transverse edges 36 and 37 do not quite meet, and therefore one transverse edge 36 or 37 runs past the respective detection means 39 or 40 at a later stage than the other transverse edge 36 or 37. FIG. 5 shows the example where the front transverse edge 36, that is to say the end of the upper layer, of the item of laundry 10 with the first transverse folds passes the detection means 40 only once the rear transverse edge 37 has already run past the detection means 39. This means that, when the first transverse-folding operation has been fully completed, the front transverse edge 36, which forms the rear end of the upper layer, projects above the end of the lower layer.

According to the invention, the extent, that is to say the length or distance, of the difference in overlap established for the first transverse-folding operation of an item of laundry is used in order to compensate for this difference in overlap at least by computational means for the next-following item of laundry 10.

The difference in overlap is established by the distance which the upper strands 22 and 25 of the belt conveyors 17 and 18, moving at the same constant speed in the through-passage direction 16, cover between the rear transverse edge 37 running past the detection means 39 and the front transverse edge 36 running past the detection means 40. The illustration of FIG. 5, where the upper layer or half of the item of laundry 10, said layer or half running past the detection means 40, is trailing in relation to the lower layer or half, is based on a positive difference in overlap. It would also be possible, in principle, however, for this difference to be defined as a negative difference in overlap.

The positive difference in overlap, with trailing front transverse edge 36 of the upper layer, illustrated in FIG. 5 is compensated for by computational means using a corresponding control or regulating means, in that the positive difference in overlap established for the currently folded item of laundry 10 is used for a corresponding virtual shifting of the centre axis 38 of the following item of laundry 10. This takes place, in the case of a positive difference in overlap in FIG. 5, such that the center axis 38 of the next-following item of laundry 10 is shifted forwards, that is to say displaced forwards, in the through-passage direction 16 by half the difference in overlap established for the preceding item of laundry 10. The transverse-folding operation of the following item of laundry then begins at an earlier stage, when the front transverse edge 36 has not yet run so far onto the upper strand 25 of the belt conveyor 18, and therefore it is theoretically then the case that the two transverse edges 36 and 37 of the item of laundry 10 would have to run past the detection means 39 and 40 at the same time. In practice, this is not possible, in particular on account of material properties of the textiles or else different types of fabric. For this reason, provision is preferably made, for all the items of laundry 10 which are to be folded, for the extent of overlap to be established and for corresponding compensation to be carried out for the next item of laundry 10 in each case. This means that something approaching constant compensation of an established difference in overlap takes place, and this may therefore be referred to as "auto-adaptation". It may be expedient here for the compensation for the difference in overlap of the preceding item of laundry 10 to take place for the next one only when the difference in overlap lies outside a defined or definable tolerance range.

It may also be advantageous to store established differences in overlap of a number of successive items of laundry 10 and to use averaging or statistical methods to form a correction value which leads to a difference in overlap which is as small as possible in computational or statistical terms.

The method may also expediently be designed such that correction values from certain folding programs are stored for a respective folding program and these stored values are taken into account individually again when the same folding program is next called up. This does away with the need for altering the setting of the folding machine, even after a relatively long operating period and, for example, decreasing tensioning of the belts of the belt conveyors 17 to 21.

In the case of a negative difference in overlap, that is to say when the detection means 39 establishes that the rear transverse edge 37 of the item of laundry is trailing, the procedure is carried out in reverse order, that is to say the center axis 38 is shifted computationally rearwards, counter to the through-passage direction 16, by half the negative extent of overlap established.

Whereas the length of the item of laundry 10 is halved in the case of the first transverse-folding operation at the transverse-folding station 13, the length of the item of laundry 10 is quartered at the second transverse-folding station 14 in that the two layers located one above the other, said layers being formed during the first transverse-folding operation, are positioned one above the other again to form a total of four layers. Here too, the difference in overlap is determined by the detection means 39 and 40, to be precise in a manner analogous to the manner described above in conjunction with the first transverse-folding station 13. The only difference is that, at the second transverse-folding station 14, the detection means 40, which is assigned to the upper strand 26 of the belt conveyor 19, determines that end of the item of laundry 10, running transversely to the through-passage direction 16, at which the two layers produced in the first transverse-folding station 13 are interconnected. The detection means 39 at the belt conveyor 17 determines the final transverse edge of the item of laundry 10 running past the same, to be precise, in the exemplary embodiment of FIG. 5, the front transverse edge 36, which was the trailing edge in the case of the first transverse-folding operation.

In the third transverse-folding station 15, the length of the item of laundry 10 is folded into eight, to form eight layers located one above the other. Here too, the difference in overlap is determined once again by the detection means 39 and 40, to be precise in a manner analogous to the manner which has been described above in conjunction with the transverse-folding stations 13 and 14.

In contrast to the transverse-folding stations 13 and 14, the leading part of the item of laundry 10 already with four layers located one above the other is transported onto the upper strand 31 of the belt conveyor 20, between the deflecting drum 24 at the end of the upper strand 23 of the belt conveyor 17 and the directing drum 33, first of all with the leading end, as seen in the through-passage direction 16. The upper strand 31 here is driven in the direction of the trough mangle 11. As soon as the actual center axis 38, or the center axis defined by the overlap-control means, is positioned upstream of the transverse-folding gap 32 of the third transverse-folding station 15, the belt conveyor 20 is driven in the opposite direction and the item of laundry 10 is folded transversely for a third time between the directing drum 33 and the upper strand 31 of the belt conveyor 20, and therefore the item of laundry has eight layers located one above the other and has been folded into eight lengthwise. The definitively folded item of laundry 10 is then transported away from the belt conveyor 21, for example to a stacking station, in the through-passage direction 16.

In the case of the method outlined above, in which the item of laundry 10 is folded transversely three times one after the other, the difference in overlap is determined individually at each transverse-folding station 13, 14, and 15. The established difference in overlap is then used to correct the transverse-folding operation of the next item of laundry in each case. The extent of overlap is corrected individually at each transverse-folding station 13, 14, 15, to be precise in dependence on the difference in overlap established previously at the same transverse-folding station 13, 14, 15.

If relatively short items of laundry, requiring for example just one or just two transverse-folding operations, are to be folded transversely, the second transverse-folding station 14 and/or the third transverse-folding station 15 remain/remains unused. The difference in overlap is then not determined at the respectively unused transverse-folding station.

Items of laundry which pass transversely through the trough mangle 11 are folded transversely in an analogous manner. In this case, that dimension of the item of laundry which extends in the through-passage direction 16, and is the actual width, that is to say the distance between the longitudinal peripheries running transversely to the through-passage direction 16, is to be considered the "length" in the manner of the method described above.

The method according to the invention is also suitable for multi-track trough mangles 11 or folding apparatuses 12, where items of laundry located next to one another are mangled, and folded, in a number of tracks. In this case, each track of the folding apparatus 12 has detection means 39 and 40, to be precise preferably in each transverse-folding station 13, 14, and 15.

The method according to the invention is also suitable for folding apparatuses having more or fewer than three transverse-folding stations.

The invention and, in particular, the method according to the invention can also be implemented with the difference in overlap being determined at just one transverse-folding station, preferably the first transverse-folding station 13.

The invention is also suitable for folding apparatuses 12 which, in addition to the at least one transverse-folding operation, also carry out at least one longitudinal-folding operation and also for folding apparatuses which, rather than being arranged downstream of a trough mangle 11, are arranged downstream of some other laundry machine, for example a finisher or a dryer.

LIST OF DESIGNATIONS

10 Item of laundry
11 Trough mangle
12 Folding apparatus
13 Transverse-folding station
14 Transverse-folding station
15 Transverse-folding station
16 Through-passage direction
17 Belt conveyor
18 Belt conveyor
19 Belt conveyor
20 Belt conveyor
21 Belt conveyor
22 Upper strand
23 Upper strand
24 Deflecting drum
25 Upper strand
26 Upper strand
27 Deflecting drum
28 Deflecting drum
29 Transverse-folding gap
30 Transverse-folding gap
31 Upper strand
32 Transverse-folding gap
33 Directing drum
34 Through-passage gap
35 Length-measuring device
36 Front transverse edge
37 Rear transverse edge
38 Center axis
39 Detection means
40 Detection means

What is claimed is:

1. A method of folding items of laundry (10), wherein the items of laundry (10), in a folding apparatus (12), are folded transversely at least once in relation to the direction (16) of passage through the folding apparatus (12) and, in the process, are at least halved lengthwise, as seen in the through-passage direction (16), as a result of overlapping layers of the item of laundry (10) being formed, wherein it is determined whether at least one difference in overlap is present and any difference in overlap which may be determined is corrected for the following item of laundry (10).

2. The method according to claim 1, wherein the at least one difference in overlap is determined continuously and/or contactlessly.

3. The method according to claim 1, wherein the difference in overlap is determined by virtue of the two ends of the item of laundry (10) being detected just prior to the respective transverse-folding location being reached.

4. The method according to claim 3, wherein the two ends are transverse edges (36, 37).

5. The method according to one claim 1, wherein the difference in overlap determined is used for the transverse-folding operation of at least one next item of laundry (10).

6. The method according to claim 5, wherein the difference in overlap determined is used for the transverse-folding operation of at least one next item of laundry (10) in order at least partially to compensate for an established difference in overlap for following items of laundry (10).

7. The method according to claim 1, wherein, in the case of a number of successive transverse-folding operations, the difference in overlap is determined in each case for all of the transverse-folding operations.

8. The method according to claim 1, wherein the difference in overlap is compensated for depending on whether a positive or negative difference in overlap has been determined, wherein following items of laundry (10) are folded transversely when the half-length of the item of laundry (10) plus or minus half the difference in overlap is located at the relevant transverse-folding location.

9. The method according to claim 1, wherein, in the case of a number of successive transverse-folding operations, the difference in overlap is determined in each case for a number of the transverse-folding operations.

10. The method according to claim 9, wherein, in the case of the number of transverse-folding operations, the difference in overlap is determined in relation to the relevant transverse-folding operation and, in the case of the transverse-folding operation of the next item of laundry (10), the difference in overlap determined for the respective transverse-folding operation is taken into account.

11. The method according to claim 9, wherein, in the case of the number of transverse-folding operations, the difference in overlap is determined in relation to the relevant transverse-folding operation and, in the case of the transverse-folding operation of the next item of laundry (10), the difference in overlap determined for the respective transverse-folding operation is compensated for.

12. The method according to claim 1, wherein, in the case of each item of laundry (10) being folded transversely one after the other, the difference in overlap is determined for at least one transverse-folding operation and the at least one established difference in overlap is taken into account in the case of the transverse-folding operation at least of the next item of laundry (10).

13. The method according to claim 1, wherein, prior to the first transverse-folding operation, the length of the item of laundry (10) is determined in the direction (16) in which it passes through the folding apparatus (12).

14. An apparatus for folding items of laundry (10), having at least one transverse-folding station (13, 14, 15) and having belt conveyors (17, 18, 19, 20, 21), by means of which the item of laundry (10) which is to be folded in each case is transported in the through-passage direction (16) through at least one transverse-folding gap (29, 30, 32), which belongs to the at least one transverse-folding station (13, 14, 15) and in which the respective item of laundry (10) receives a transverse fold, which runs transversely to the through-passage direction (16) and which produces overlapping layers of the item of laundry (10), and comprising:

detection means (39, 40) arranged on opposite sides of the at least one of transverse-folding gap (29, 30, 32) for detecting opposite ends of the respective item of laundry (10) which run transversely to the through-passage direction (16); and at least one length-measuring device (35), which interacts with the detection means (39, 40) on either side of the at least one transverse-folding gap (29, 30, 32), wherein the length-measuring device (35) is arranged upstream of the first transverse-folding station (13) in order to determine that dimension of the item of laundry (10) to be folded in each case which extends in the through-passage direction (16).

15. The apparatus according to claim 14, wherein the detection means (39, 40) are arranged on different sides of the at least one transverse-folding gap (29, 30, 32), each at an equal distance from the transverse-folding gap (29, 30, 32).

16. The apparatus according to claim 14, wherein the dimension of the item of laundry (10) to be folded in each case which extends in the through-passage direction (16) is the length of the item of laundry (10) to be folded.

17. The apparatus according to claim 14, wherein the length-measuring device (35) is arranged upstream of the first transverse-folding station (13) at least by half the length of the largest item of laundry (10) which is to be folded.

* * * * *